US006914369B2

(12) United States Patent
Liao

(10) Patent No.: US 6,914,369 B2
(45) Date of Patent: Jul. 5, 2005

(54) QUICK TEMPERATURE-RAISING STRUCTURE OF COLD CATHODE FLUORESCENT LAMP

(75) Inventor: Shu Wei Liao, Pa-Teh (TW)

(73) Assignee: ADO Optronics Corporation, Pa-Teh (TW)

( * ) Notice: Subject to any disclaimer, the term of this patent is extended or adjusted under 35 U.S.C. 154(b) by 142 days.

(21) Appl. No.: 10/357,464

(22) Filed: Feb. 4, 2003

(65) Prior Publication Data

US 2004/0150307 A1 Aug. 5, 2004

(51) Int. Cl.[7] ..... H01J 61/52
(52) U.S. Cl. ..... 313/11; 313/15; 313/485; 362/260
(58) Field of Search ..... 313/485, 11, 15, 313/18–19, 33, 38, 44, 46–47; 315/32, 49; 362/260

(56) References Cited

U.S. PATENT DOCUMENTS 5,747,946 A * 5/1998 Tyler ..... 315/291
5,898,275 A * 4/1999 Taillie et al. ..... 315/115
6,727,649 B1 * 4/2004 Yano et al. ..... 313/607
6,833,657 B2 * 12/2004 Voto et al. ..... 313/11

FOREIGN PATENT DOCUMENTS

JP 10188902 A * 7/1998 ..... H01J/61/52
JP 11283427 A * 10/1999 ..... F21V/8/00

* cited by examiner

*Primary Examiner*—Karabi Guharay
(74) *Attorney, Agent, or Firm*—Browdy and Neimark, P.L.L.C.

(57) ABSTRACT

A quick temperature-raising structure of cold cathode fluorescent lamp comprises a cold cathode fluorescent lamp, a soft electric heating component, an insulating tube and two insulating components. The soft electric heating component adheres onto the surface of the cold cathode fluorescent lamp. The insulating tube is slipped onto the surface of the cold cathode fluorescent lamp. The two insulating components are slipped onto the joint portions at two sides of the cold cathode fluorescent lamp, the soft electric heating component and the insulating tube. Grooves are formed on the insulating components so that an external power source can provide the working power for the soft electric heating component and the cold cathode fluorescent lamp via conducting wires. The soft electric heating component can heat in advance to quickly raise the ambient temperature of the cold cathode fluorescent lamp when the cold cathode fluorescent lamp is driven.

4 Claims, 5 Drawing Sheets

QUICK TEMPERATURE-RAISING STRUCTURE OF COLD CATHODE FLUORESCENT LAMP

FIELD OF THE INVENTION

The present invention relates to a quick temperature-raising structure of cold cathode fluorescent lamp and, more particularly, to a structure capable of quickly raising the ambient temperature of a cold cathode fluorescent lamp thereof when the cold cathode fluorescent lamp is driven.

BACKGROUND OF THE INVENTION

In a cold cathode fluorescent lamp (CCFL), mercury atoms are excited to radiate out ultraviolet (UV) lights, which then let fluorescent material emit out visible lights.

As shown in FIG. 1, a cold cathode fluorescent lamp 60 is formed by coating fluorescent lacquer on part of the inward wall of a lamp 61 made of quartz. Reflecting coating layers 62 and 63 are then deposited or added on the lamp 61 to let the cold cathode lamp have a directionality. All light emitted by the cold cathode lamp 60 will be radiated out via a radiation aperture provided by the reflecting coating layers 62 and 63.

If the cold cathode fluorescent lamp 60 is used in a car dashboard, because it is unstable at low temperatures, the brightness thereof will be unstable except after a certain time. If the ambient temperature of the cold cathode fluorescent lamp 60 can be raised instantaneously, the above drawback can be avoided.

Accordingly, the present invention aims to provide a structure capable of quickly raising the ambient temperature of a cold cathode fluorescent lamp thereof when the cold cathode fluorescent lamp is driven.

SUMMARY OF THE INVENTION

The object of the present invention is to provide a structure capable of quickly raising the ambient temperature of a cold cathode fluorescent lamp thereof when the cold cathode fluorescent lamp is driven. Because the cold cathode fluorescent lamp is not initially powered and its ambient temperature is quickly raised only when drive, the problems of more power dissipation and unstable brightness in the prior art can be solved.

To achieve the above object, in the present invention, a soft flexible electric heating component adheres onto the surface of the cold cathode fluorescent lamp, and an insulating tube is slipped onto the surface of the cold cathode fluorescent lamp. Two insulating components are slipped onto the joint portions at two ends of the cold cathode fluorescent lamp, the flexible electric heating component and the insulating tube, respectively. Grooves are formed on the insulating components so that an external power source can simultaneously provide the working power for the flexible electric heating component and the cold cathode fluorescent lamp via conducting wires.

The above flexible electric heating component is formed by sticking a way and stripy flexible electric heating filament on the surface of a film sheet.

The various objects and advantages of the present invention will be more readily understood from the following detailed description when read in conjunction with the appended drawing, in which:

DETAILED DESCRIPTION OF THE PREFERRED EMBODIMENTS

Figure 1:
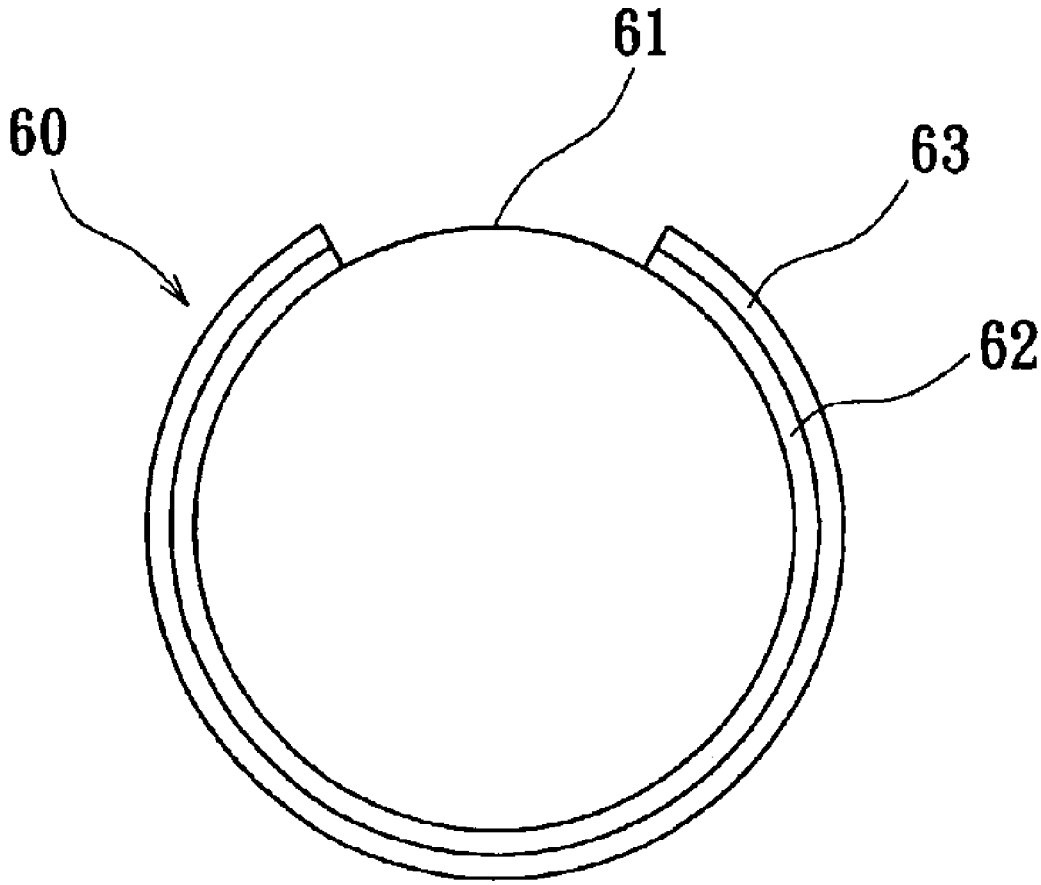
FIG. 1 PRIOR ART
FIG. 1 is a cross-sectional view of a conventional cold cathode fluorescent lamp.
Figure 2:
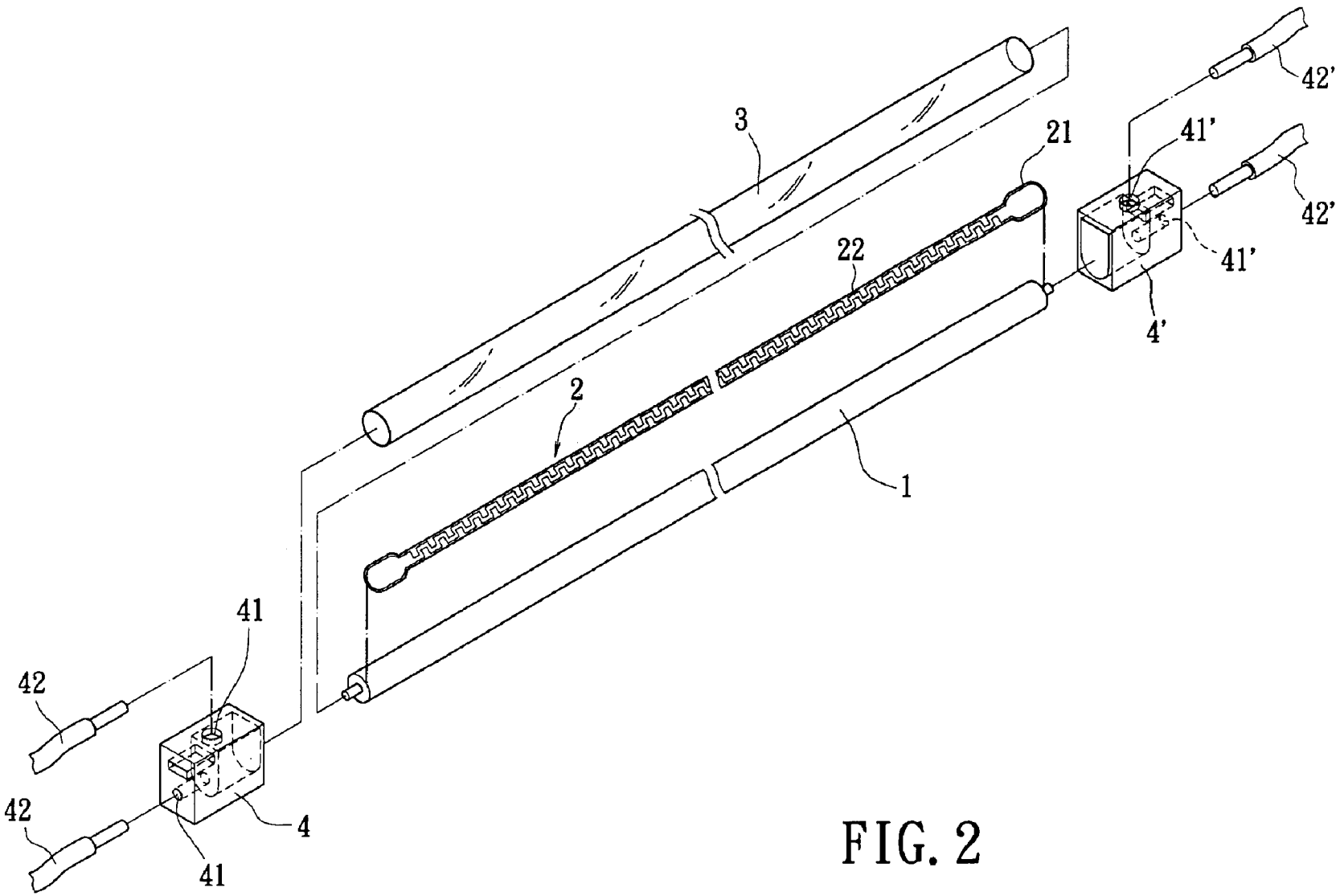
FIG. 2 is an exploded perspective view of the present invention.
Figure 3:
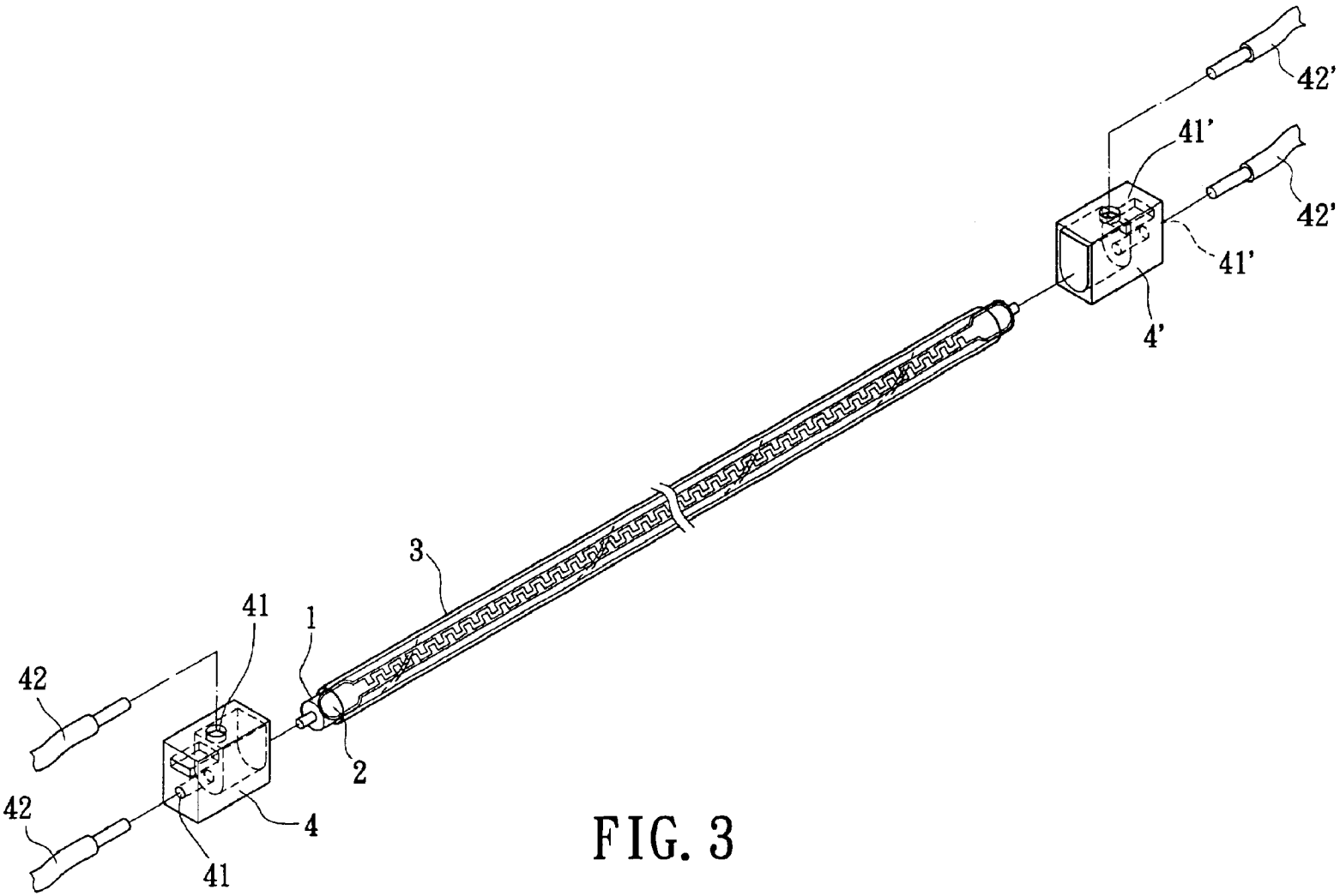
FIG. 3 is another exploded perspective view of the present invention.
Figure 4:
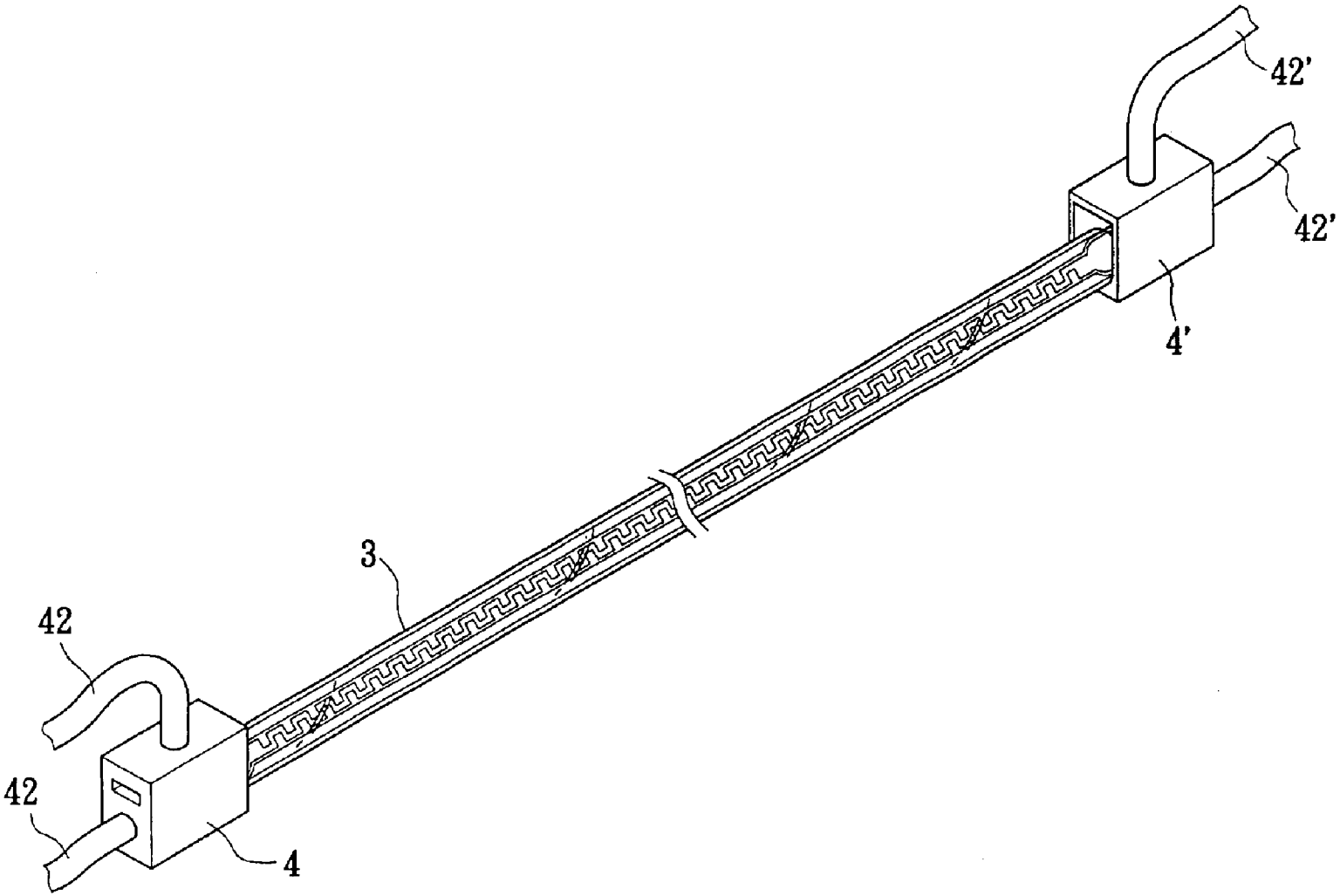
FIG. 4 is an perspective assembly view of the present invention.
Figure 5:
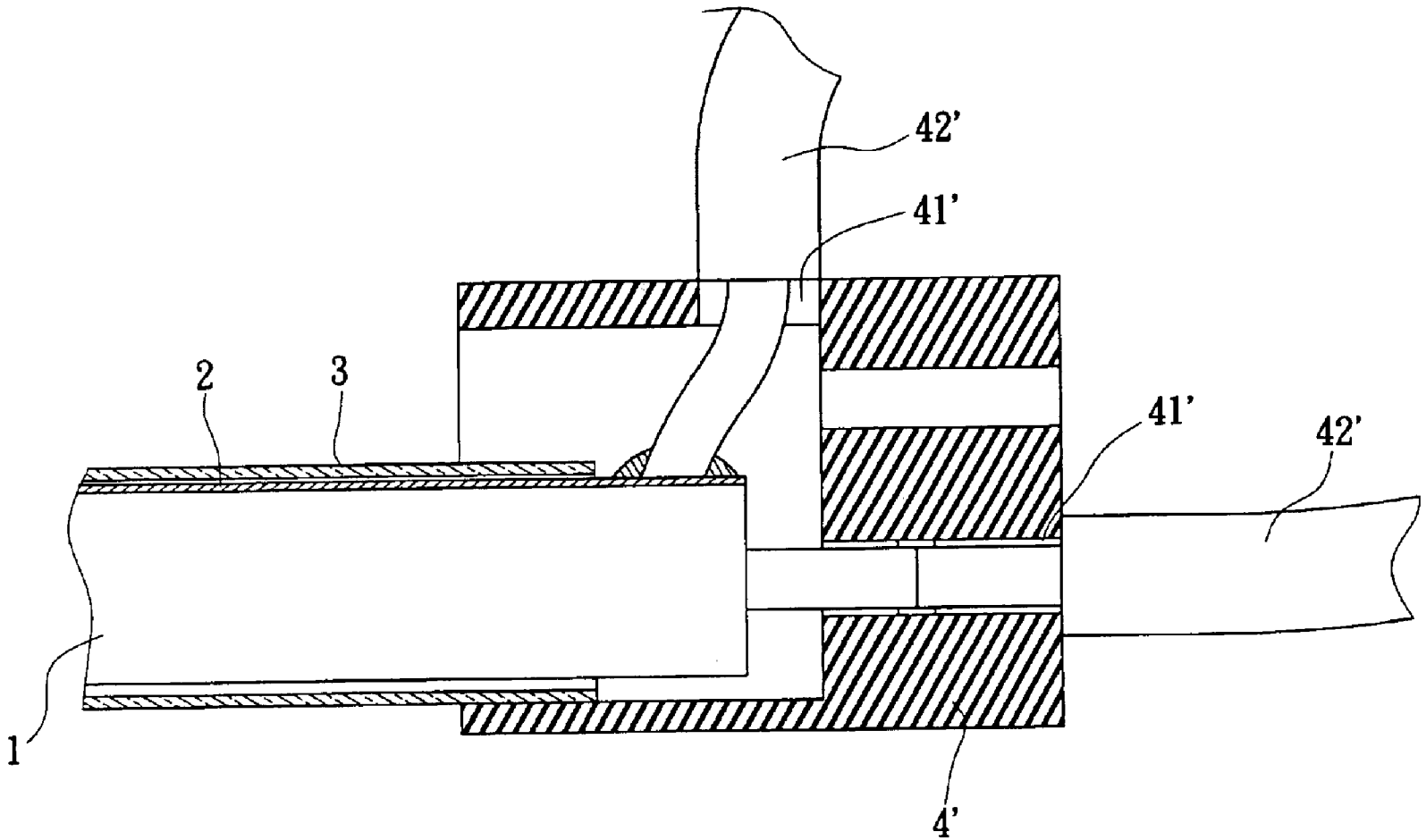
FIG. 5 is a partial cross-sectional view of the present invention.

As shown in FIGS. 2 to 5, a quick temperature-raising structure of cold cathode fluorescent lamp of the present invention used in car dashboards or related electric appliances comprises a cold cathode lamp fluorescent 1, a flexible electric heating component 2, an insulating tube 3 and two insulating components 4 and 4'.

The cold cathode fluorescent lamp 1 is a cold cathode light source containing mercury, and is powered by an external power source to radiate. The length of the cold cathode fluorescent lamp 1 is longer than the width thereof. The cold cathode fluorescent lamp 1 is not initially powered.

The flexible electric heating component 2 is formed by sticking a flexible electric heating filament 22 onto a film sheet 21. In this embodiment, the flexible electric heating component 2 is of a wavy and stripy shape. The flexible electric heating filament 22 adheres onto the surface of the cold cathode fluorescent lamp 1 through the film sheet 21. The flexible electric heating component 2 is powered by the above external power source to work, and can heat in advance when the cold cathode fluorescent lamp is driven.

The insulating tube 3 is a hollow transparent tube, and is slipped onto the surface of the cold cathode fluorescent lamp 1 so that the flexible electric heating component 2 can be fixed on the surface of the cold cathode fluorescent lamp 1.

The insulating components 4 and 4' are joined at the connection portions at two sides of the cold cathode fluorescent lamp 1, the electric heating component 2 and the insulating tube 3. Each of the insulating components 4(4') has two grooves 41(41') so that two conducting wires 42(42') can be connected to a corresponding end of the flexible electric heating filament 22 and the cold cathode fluorescent lamp 1. The flexible electric heating component 2 can heat in advance to quickly raise the ambient temperature of the cold cathode lamp 1 to the working temperature thereof when the cold cathode fluorescent lamp 1 is driven.

The flexible electric heating component 2 can also be replaced with a flexible electric heating sheet or another heating component having the same effect.

To sum up, through the structure design of the present invention, because the cold cathode fluorescent lamp is not initially powered and its ambient temperature is quickly raised only when driven, the problems of more power dissipation and unstable brightness in the prior art can be solved.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A quick temperature-raising structure of cold cathode fluorescent lamp comprising:

a cold cathode fluorescent lamp having a glass tube and two pins, said two pins fixed respectively on two ends of said glass tube;

a flexible electric heating component having a transparent turn sheet and a metal resistance heating filament formed on said film sheet, wherein said film sheet is substantially I-shaped and disposed on said cold cathode fluorescent lamp;

a hollow transparent insulating tube having a diameter larger than that of said cold cathode fluorescent lamp covering around a periphery of said cold cathode fluorescent lamp, said heating component disposed between said insulating tube and said cold cathode fluorescent lamp;

and a pair of insulating members respectively formed with a holding cavity, each of the insulating members having first and second grooves communicating with said holding cavity, wherein ends of said cold cathode fluorescent lamp are received in said holding cavity respectively, said first groove is plugged with a first wire and one of said pins of said cold cathode fluorescent lamp, and said second groove is plugged with a second wire, said electric heating component is adjacent to said second groove and electrically connected to said second wire.

2. The quick temperature raising structures of cold cathode fluorescent lamp as claimed in claim 1, wherein said heating filament of said flexible electric heating component is formed in a wavy and stripy manner, and is adhered on a surface of said cold cathode fluorescent lamp.

3. The quick temperature-raising structure of cold cathode fluorescent lamp as claimed in claim 1, wherein said first groove is perpendicular to said second groove.

4. The quick temperature-raising structure of cold cathode fluorescent lamp as claimed in claim 1, wherein a length of said heating component is substantially longer than that of said transparent insulating tube, and wherein two ends of said heating filament are exposed outside said transparent insulating tube.

* * * * *